US006595196B2

(12) United States Patent
Bath

(10) Patent No.: US 6,595,196 B2
(45) Date of Patent: Jul. 22, 2003

(54) DUST-FREE MASONRY CUTTING TOOL

(76) Inventor: Michael Bath, 1025 Ridge Rd., Orangeville, PA (US) 17859

( * ) Notice: Subject to any disclaimer, the term of this patent is extended or adjusted under 35 U.S.C. 154(b) by 0 days.

(21) Appl. No.: 09/884,411

(22) Filed: Jun. 19, 2001

(65) Prior Publication Data

US 2002/0045415 A1 Apr. 18, 2002

Related U.S. Application Data

(60) Provisional application No. 60/213,127, filed on Jun. 22, 2000.

(51) Int. Cl.[7] ..... B28D 1/04

(52) U.S. Cl. ..... 125/13.01; 125/13.03; 451/449; 451/450

(58) Field of Search ..... 125/13.01, 13.03, 125/11.22; 451/449–450; 83/171, 169, 168

(56) References Cited

U.S. PATENT DOCUMENTS

| | | | | | |
|---|---|---|---|---|---|
| 3,896,783 | A | * | 7/1975 | Manning | 125/13.01 |
| 4,188,934 | A | * | 2/1980 | Reinhardt et al. | 125/13.01 |
| 5,676,124 | A | * | 10/1997 | Lee | 125/13.01 |
| 6,000,387 | A | * | 12/1999 | Lee | 125/13.01 |
| 6,013,079 | A | * | 1/2000 | Salam | 606/82 |
| 6,375,558 | B1 | * | 4/2002 | Baratta | 125/13.01 |

* cited by examiner

*Primary Examiner*—Lee D. Wilson

(57) ABSTRACT

A method for dust-free cutting of rotating a cutting blade at a predetermined rotational speed to create turbulent flow of air on the face of the cutting blade, directing a liquid coolant against the face of the cutting blade whereby the coolant is dispersed on the spinning blade and captures or entrains the dust particles created and converts the same a harmless slurry.

2 Claims, 10 Drawing Sheets

DUST-FREE MASONRY CUTTING TOOL

This application claims the benefit of U.S. Provisional Application No. 60/213,127 filed Jun. 22, 2000.

FIELD OF THE INVENTION

The present invention relates broadly to system and apparatus for grinding or cutting masonry or stone products and typically comprise a disc-like cutting blade rotatable at high speeds. These cutters or grinders are used in rehabilitating old brick buildings to remove the mortar between the bricks commonly referred to as "tuck pointing". When tuck pointing, workers use power grinders to dig into the mortar to a depth of an inch or less. The grinders operate at a high speeds of 12,000 rpms and create dust in the form of respirable crystalline silica. It has been observed that when workers are exposed to low concentrations of the respirable crystalline silica they develop silicosis which is a deadly lung disease. The workers wear protective masks. However, these masks have a limited effectiveness and are not a guarantee in preventing silicosis. Furthermore, in rehabilitating old buildings, the dust particles often migrate in the general vicinity and can be inhaled by persons outside the work area and present a risk of silicosis.

With the above in mind, it is an object of the present invention to provide an improvement in equipment of this type, which essentially eliminates the harmful dust formation generated, for example, in tuck pointing operations and others and essentially entrains the dust particles in the liquid coolant and creates a harmless slurry. It has been observed that the state of the art grinders or cutters operate at very high speeds and by reason of this the air flow across the face of the cutting blade is laminar which is believed to prevent dispersement of the coolant in a manner to co-mingle or entrain with all of dust particles. It has been found that smaller cutting tools having blades in the order of approximately 4–6 inches in diameter operated at comparatively low speeds in the order of 5000–7000 rpms produces turbulent air flow across the face of the blade which allows the coolant to disperse on the spinning blade and capture or entrain all of the dust particles and thereby create a harmless slurry. In other words, in the present application, the blade and coolant are configured and operate in such a manner to create a condition on the face of the blade believed to be turbulent flow which provides coolant flow paths to the face of the blade where it is directed peripherally to mix with and entrain dust particles and create a harmless slurry with the coolant.

In accordance with the present invention, the coolant is used for dust and particulate elimination and a byproduct is blade cooling. As noted, the coolant water dispersed on the spinning blade entrains the silica dust and produces a slurry which is now a harmless byproduct of the cutting process. More specifically, the point at which the water is directed onto the blade will greatly increase the efficiency and longevity of the blade by cooling it in addition to the conversion of the dust particles to a harmless slurry. In most cases, concrete cutting tools use large blades rotating at high speeds which creates the laminar air flow which causes difficulty in entraining the dust particulate formed during the cutting process and the air barrier created by laminar flow limits the cooling effect. The present invention, by providing the relatively small blade rotating at comparatively low speeds produces turbulent flow which enhances encapsulation or entraining of the dust particles and the cooling efficiency.

It has been found that the masonry cutting tools of the prior art do not operate in a manner wherein the coolant penetrates the air layer over the face of the blade and therefore there is no entrainment of dust particles in the coolant to form a harmless slurry. In accordance with the present invention, the cutting blade is operated in a predetermined manner and at a predetermined speed to create air flow conditions wherein the liquid coolant penetrates the layer of air on the cutting blades and by reason of this entrains the dust particles created during a cutting operation and converts the same to a harmless slurry.

With the foregoing in mind, it is the object of the present invention to provide a dust-free masonry cutting tool which minimizes operator health risks from silica dust and minimizing intrusion of this dust into the occupied spaces of the building where work is being performed.

BACKGROUND OF THE INVENTION

There are a number of prior art patents listed below which disclose water cooling systems for cooling the cutting blade, disclose water cooling systems for a blade of cutting apparatus for cutting concrete materials and the like. However, none of these prior art patents disclose or suggest the present invention which essentially removes the dust from the cutting process which if ingested can cause silicosis which is a disabling, nonreversible and sometimes fatal lung disease.

Hogue U.S. Pat. No. 4,570,609 discloses a water-cooling system for the saw hub and blade to maintain blade integrity and extend the life of the blade and is not designed for dust removal.

Long U.S. Pat. No. 4,870,946 and Lipanski U.S. Pat. No. 5,619,081 are directed to blade and hub cooling and debris removal to improve efficiency of the cutting action.

As Zerrer U.S. Pat. No. 5,826,478 discloses a nozzle for supplying a liquid to a rotating tool and discloses a specific arrangement facilitating attaching a water line to a V-belt cutter's protective cover.

Ward U.S. Pat. No. 4,236,356 shows a cutting apparatus having multiple blades used to cut safety grooves in concrete primarily in concrete steps.

Klingerman U.S. Pat. No. 4,484,417 is directed to blade cooling.

Bridwell U.S. Pat. No. 3,747,276 shows a method for contouring circular saws to maintain a sharp cutting edge while cutting hard but not abrasive materials.

Starr U.S. Pat. No. 159,048 discloses a protective device for cutting apparatus.

Tilghman U.S. Pat. No. Reissue 7,499 uses grains or globules of sand or metal to assist a cutting blade when cutting through a hard surfaces. The grains are fed into the saw-kerf with small streams of water.

Udert U.S. Pat. No. 5,468,176 discloses a disk-shaped tool to be used with an angle grinder. There is one variation of the disk utilizing water to reduce wear of the disk-like tool bits when the slot-like recesses are formed. When machining the slot-like recesses, a "U"-shaped structure remains between the disk-shaped tool bits. However, such parts can be removed by a suitable tool after the recess has been formed. This is a very inefficient operation that requires additional hand work to make a clean cut.

Grant U.S. Pat. No. 5,047,089 discloses a device and method for removing and cleaning a relatively softer material, such as asbestos, from a relatively harder surface, such as walls and ceilings. A cutting wheel is not involved.

Instead, a plurality of knives are disposed adjacent a leading side of the housing for making longitudinal and generally continuous incisions in the asbestos-containing material layer. A liquid is sprayed onto the scraped surface to wash or remove residual asbestos-containing material from the surface. A vacuum source is connected to the housing for aspirating the sprayed liquid and the asbestos-containing material removed by cutting, scraping and washing.

Sakarcan U.S. Pat. No. 4,854,295 discloses an improved cutting blade when water is used to simply cool the blade and flush loose rock-like material, spent abrasive and the like from the cutting site.

Tanizaki U.S. Pat. No. 4,569,326 relates to a dicing apparatus for micro-electric circuit fabrication such as semiconductor integrated circuits or large scale integrated circuits in which a wafer is separated into individual small-dimensioned die. Water is sprayed to lower the temperature at the face, provide lubrication and flush the cutting debris away from the cutting area. If the debris is not cleaned away, damage can result to the wafer or die being cut.

Ogyu U.S. Pat. No. 4,406,274 discloses an invention designed to limit the sound produced from the cutting tool. The water used is to provide a means for the upper cover to complete a seal at the tank area. As a byproduct, the downwardly flowing water cools and lubricates the blade.

Bloomquist U.S. Pat. No. 4,102,084 discloses a tool and a sanding device attachment designed to be used with sanding vehicle bodies for repair or repainting purposes.

Lenkevich U.S. Pat. No. 4,002,182 only discloses a confinement unit for dust created by the cutting process and a confinement unit for the water used to cool the blade.

Manning U.S. Pat. 3,896,783 discloses a water spray for cutting apparatus. The operator's vision is obstructed due to the bulk of the frame. The cutting direction is limited to one direction because of the positioning of the handles.

Schuman U.S. Pat. No. 3,722,496 shows a base plate for engaging a concrete surface to be cut and includes a water lubrication line.

Oberley U.S. Pat. No. 2,697,878 is a dental grinding wheel wherein water is used simultaneously to clean debris from between the diamond particles and cool the tool at the same time.

Miller U.S. Pat. No. 3,127,886 the primary purpose of this invention is to cool saw blades and to flush out the cut made by the saw blade.

Emmons U.S. Pat. No. 2,014,229 is a tool designed to cut slabs. It has a guide track that fastens to a slab to insure straight cuts. The water is used as a cooling medium for the blade.

Hawn U.S. Pat. No. 1,706,402 discloses that the invention is a surface polishing and sanding disk tool and is not designed to be a cutting tool. The water used in this invention is to carry a fresh supply of abrasive particles to the rotating disk.

Taylor U.S. Pat. No. 1,385,731 discloses that this invention is for sawing glass, particle in lapidary work and for cutting optical glass in lens making. A liquid is used to thoroughly lubricate and flush both sides of the saw.

Jorgens U.S. Pat. No. 1,033,592 is used for as a dental grinding device. The water reduces inflammation set up therein by a grinding action on the tooth, and hence, lessens the tendency to cause an abnormal flow of saliva.

Sun U.S. Pat. No. 6,105,567 only discloses that his invention flushes and suck away potentially damaging silicon debris produced during the scribing of this silicon wafer cutting process and dissipates any heat which is generated by the friction between the wafer and the scribing blade during the wafer sawing process.

SUMMARY OF THE INVENTION

The present invention is characterized by novel features of construction and arrangement in cutting apparatus for cutting masonry products that eliminates dust and the harmful effects of dust creation in masonry cutting tools as discussed above. In accordance with the present invention, the liquid is dispersed on the spinning blade in a predetermined manner to entrain the silica dust which is a harmful byproduct of the cutting process. Eliminating silica dust is an important consideration for many reasons including the fact that it reduces considerably operator health risks. Further it essentially eliminates dust intrusion into the occupied buildings where the work is performed and thereby essentially eliminates health risks of silica dust for the building occupants. Furthermore, it reduces cleanup costs.

The dust-free masonry cutting tool of the present invention is small, light weight, portable and easy to use in any cutting position.

Another object of the present invention is to provide a dust-free masonry cutting tool which is of a compact portable design so that it can be used to cut out mortar joints between stone and masonry units. Further, the streamlining frame does not obstruct the cutting line of site and thus the tool has the capability of cutting out material to be removed without damage to the stone or masonry units.

Another feature of the present invention is a provision of a dust-free masonry cutting tool where the point at which the liquid is directed on to the blade increases the efficiency and longevity of the blade and is of a small, compact size that substantially eliminates laminar air flow, cooling water problems and thus increases the cooling efficiency. Laminar airflow is a characteristic of the prior art larger blades, which rotate at high speeds.

In accordance with another feature of the present invention, the water supply valve can be throttled to precise flow rates, which also improves the efficiency of the overall operation.

BRIEF DESCRIPTION OF THE DRAWINGS

These and other objects of the present invention and various features and details of the construction thereof are hereinafter more fully set forth with reference to the accompanying drawings, wherein.

DESCRIPTION OF THE PREFERRED EMBODIMENTS

Figure 6:
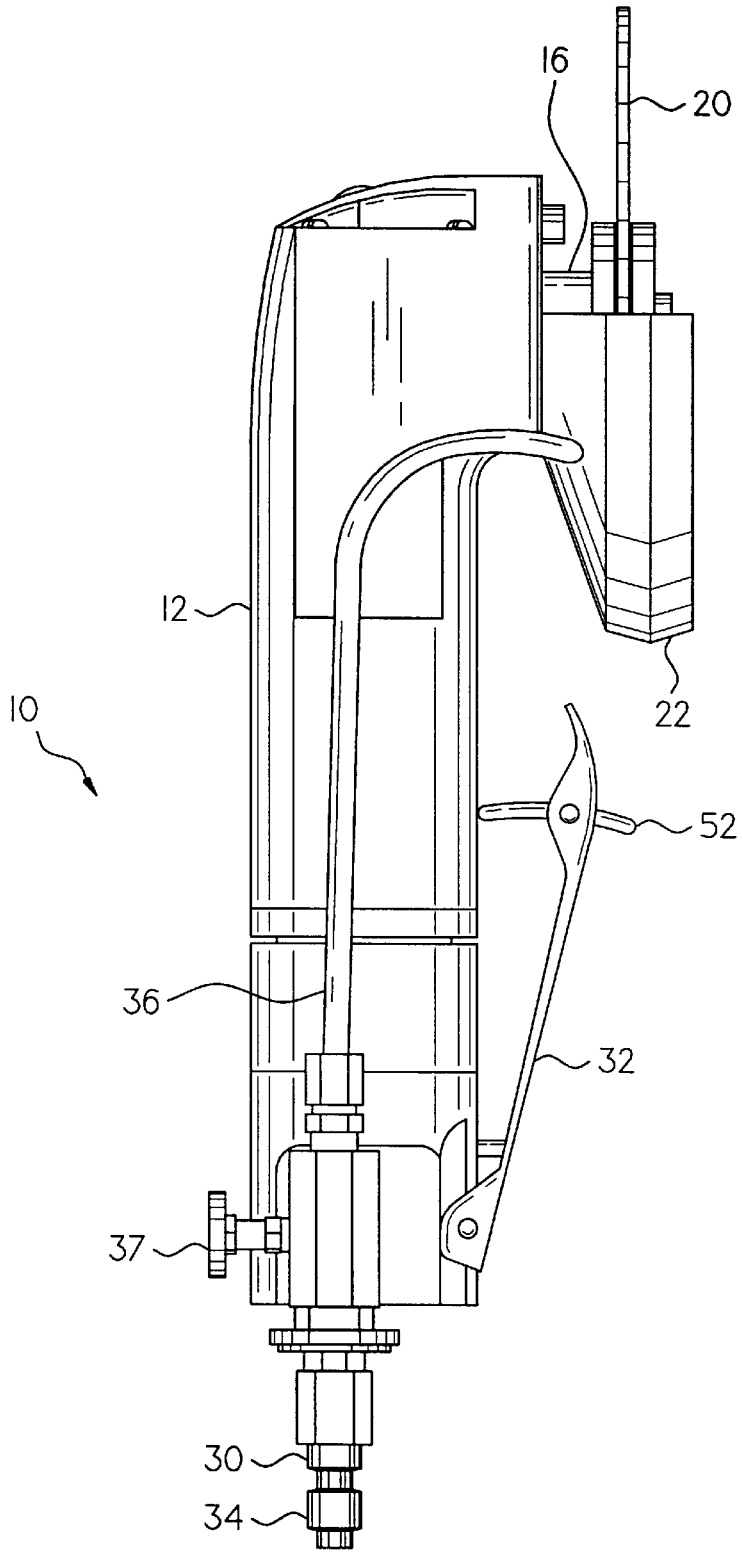
FIG. 6 is a side elevational view of a dust-free masonry-cutting tool in accordance with the present invention.
Figure 7:
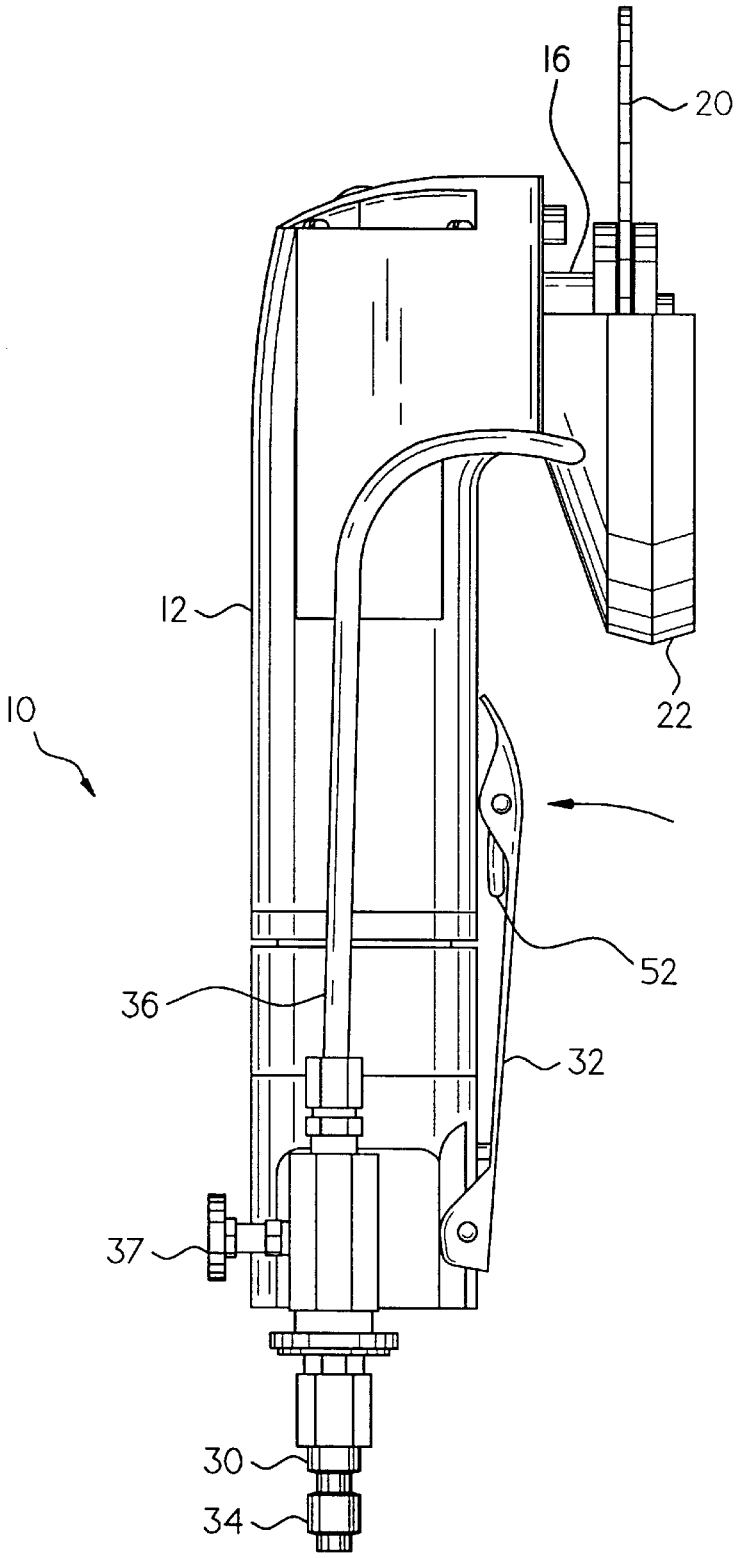
FIG. 7 is a side elevational view similar to FIG. 6 showing the switch in an activated position.
Figure 8:
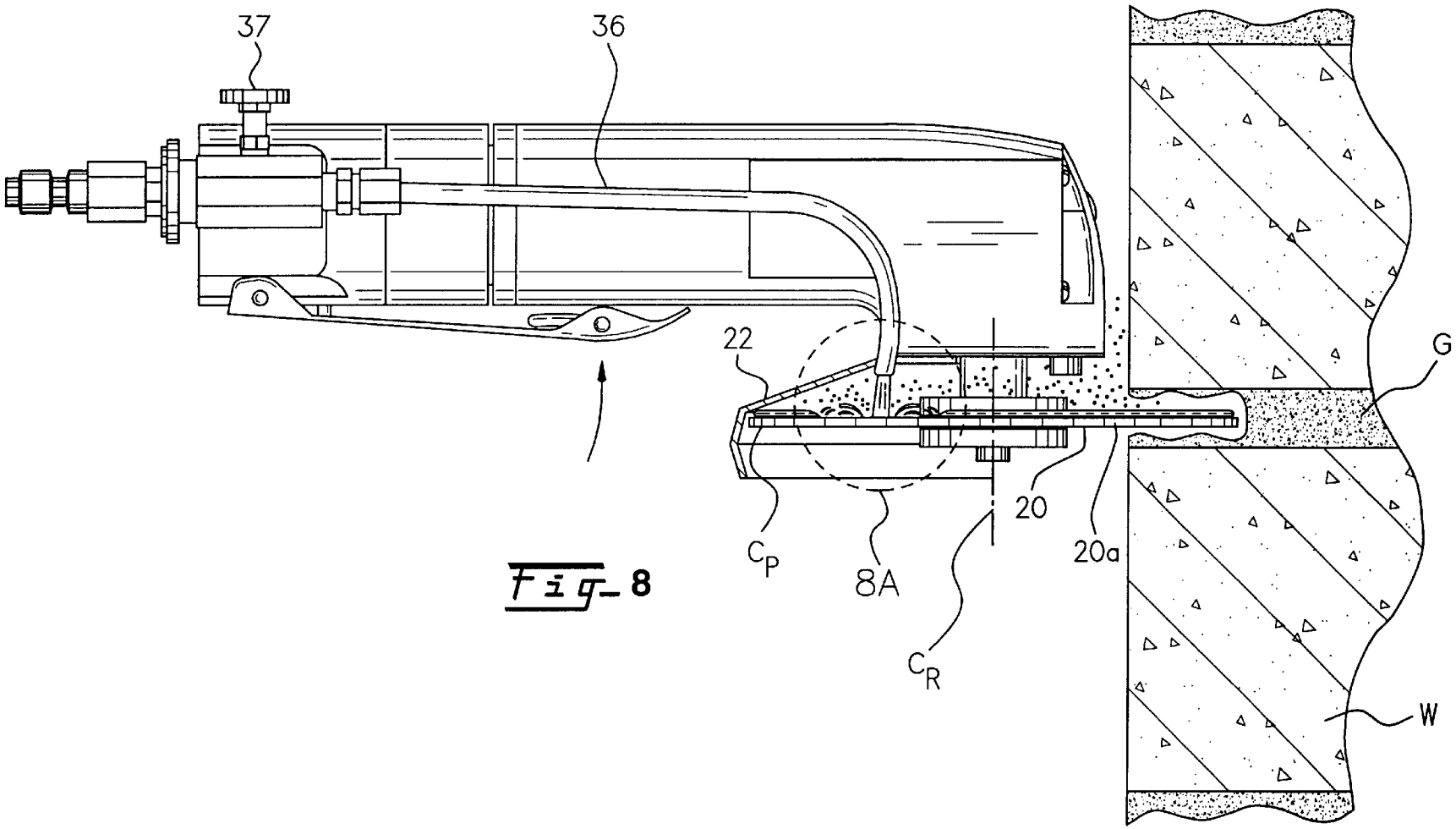
FIG. 8 is a side elevational view partly in section showing the dust-free masonry-cutting tool in use.
Figure 8A:
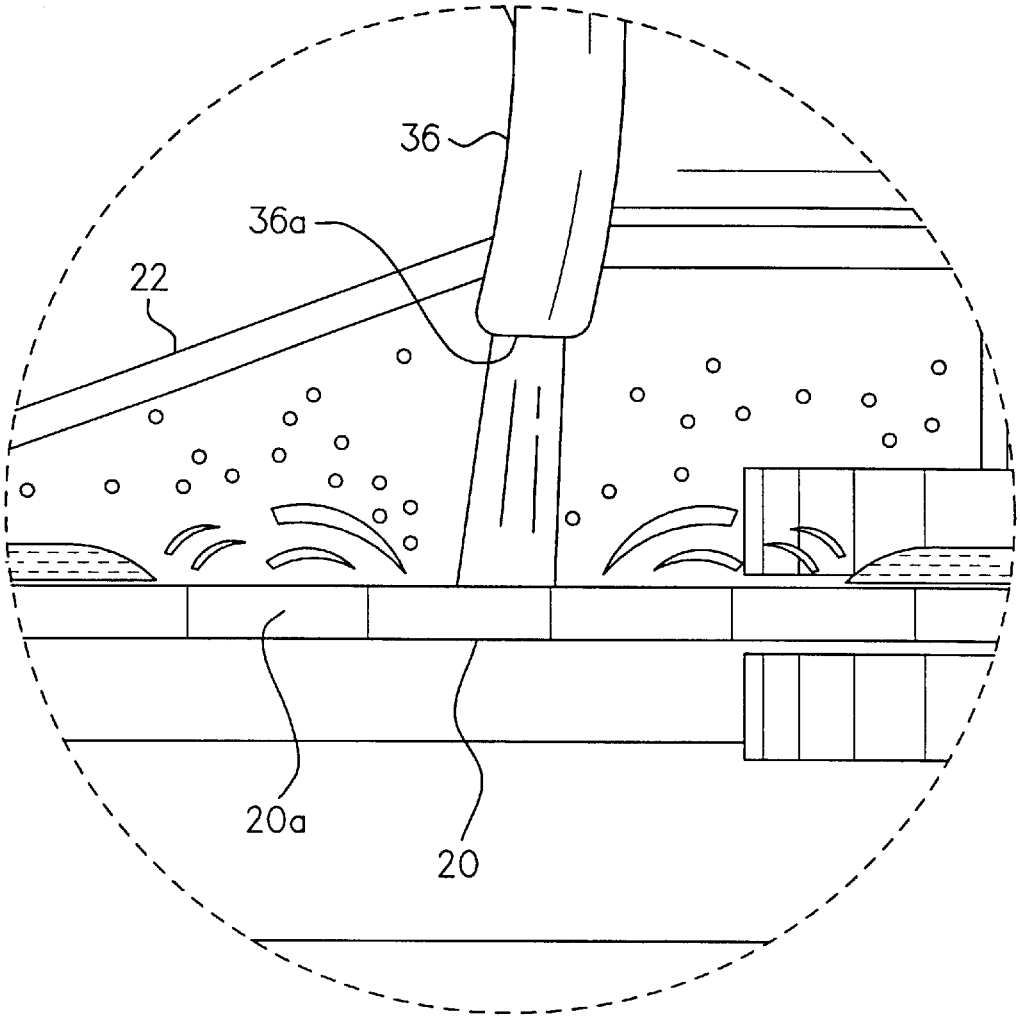
FIG. 8A is an enlarged fragmentary view of the portion circled in FIG. 8, designated 8A showing the water jet impinging the cutting blade of a dust-free masonry cutting tool in accordance with the present invention.

Referring now to the drawings and particularly to FIGS. 1–8 thereof, there is illustrated a dust-free masonry-cutting tool in accordance with the present invention. The tool, which is generally designated by the numeral 10, comprising an elongated generally cylindrical housing 12 having a handle 14 projecting from the front end thereof and a rotary shaft 16 having means for detachably mounting a generally disc-like cutting tool or blade 20. A semi-circular safety shield 22 circumscribes the cutting tool 20 to expose a portion of the cutting edge 20*a* which engages a working surface such as grouting G in a masonry wall W as illustrated in FIG. 8.

In the present instance, the tool is pneumatic and has a fitting 30 at its rear terminal end to connect it to a suitable air pressure source by means of flexible hose. A so-called "deadman's switch" 32 is mounted on the exterior of the housing 12 and can be activated between an operative position to rotate the cutting tool and an off position.

In accordance with the present invention, means is provided for directing a stream of water to a designated area of the blade 20 and to this end a fitting 34 is mounted on the housing 12 for connecting a tube 36 to a suitable source of water under pressure.

Figure 9:
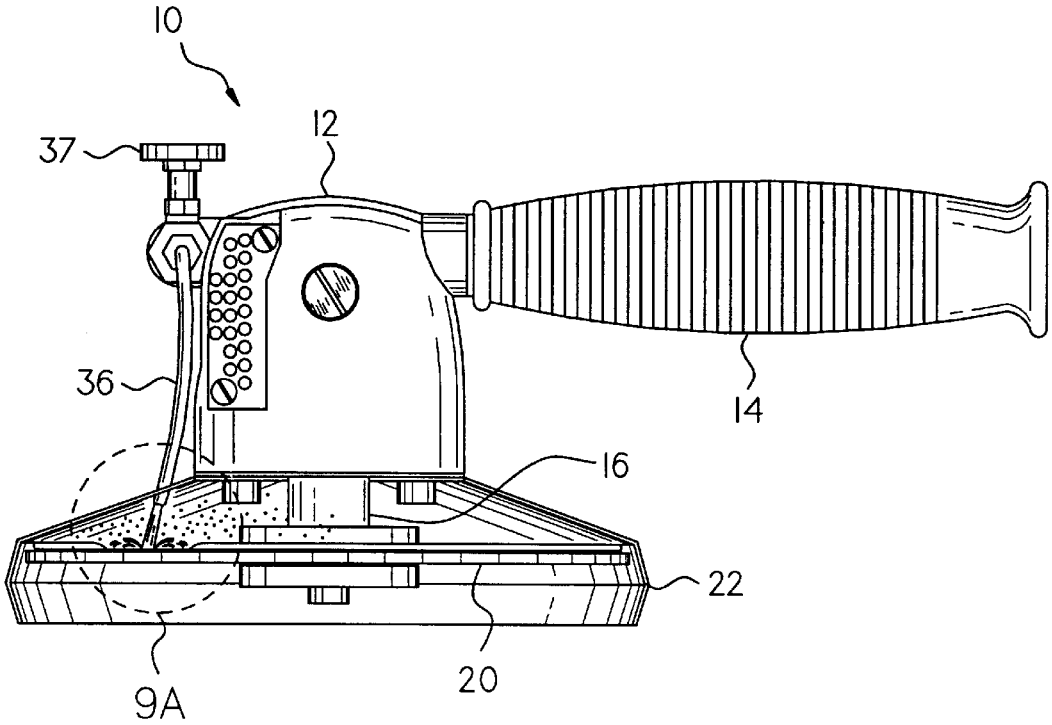
FIG. 9 is a side elevational view broken away to show the zone where the water jet impinges the cutting blade of dust-free masonry cutting tool in accordance with the present invention.
Figure 9A:
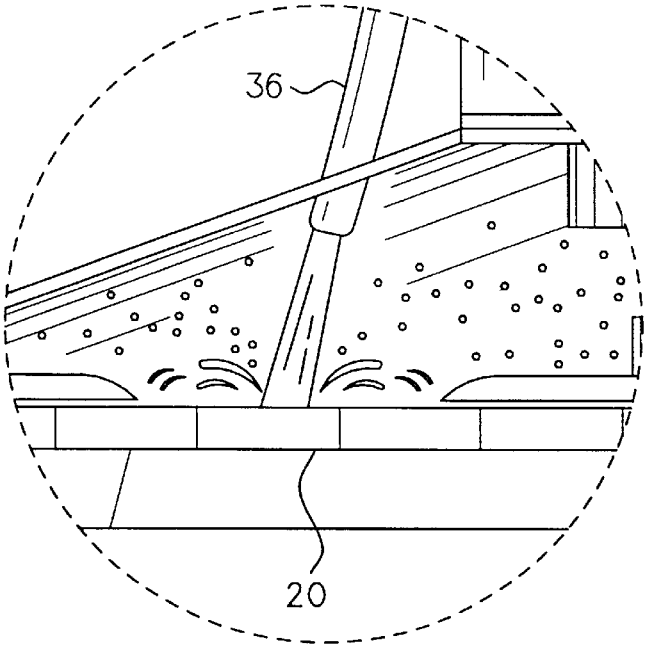
FIG. 9A is an enlarged fragmentary view showing the portion circled in FIG. 9, designated 9A.

As illustrated in FIGS. 8–9*a,* inclusive, the outer end 36*a* of the waterfeed tube 36 is positioned to direct the fluid to the top surface of the blade 20 approximately midway between the center of rotation Cr and the outer peripheral cutting edge Cp (see FIG. 8).

Figure 1:
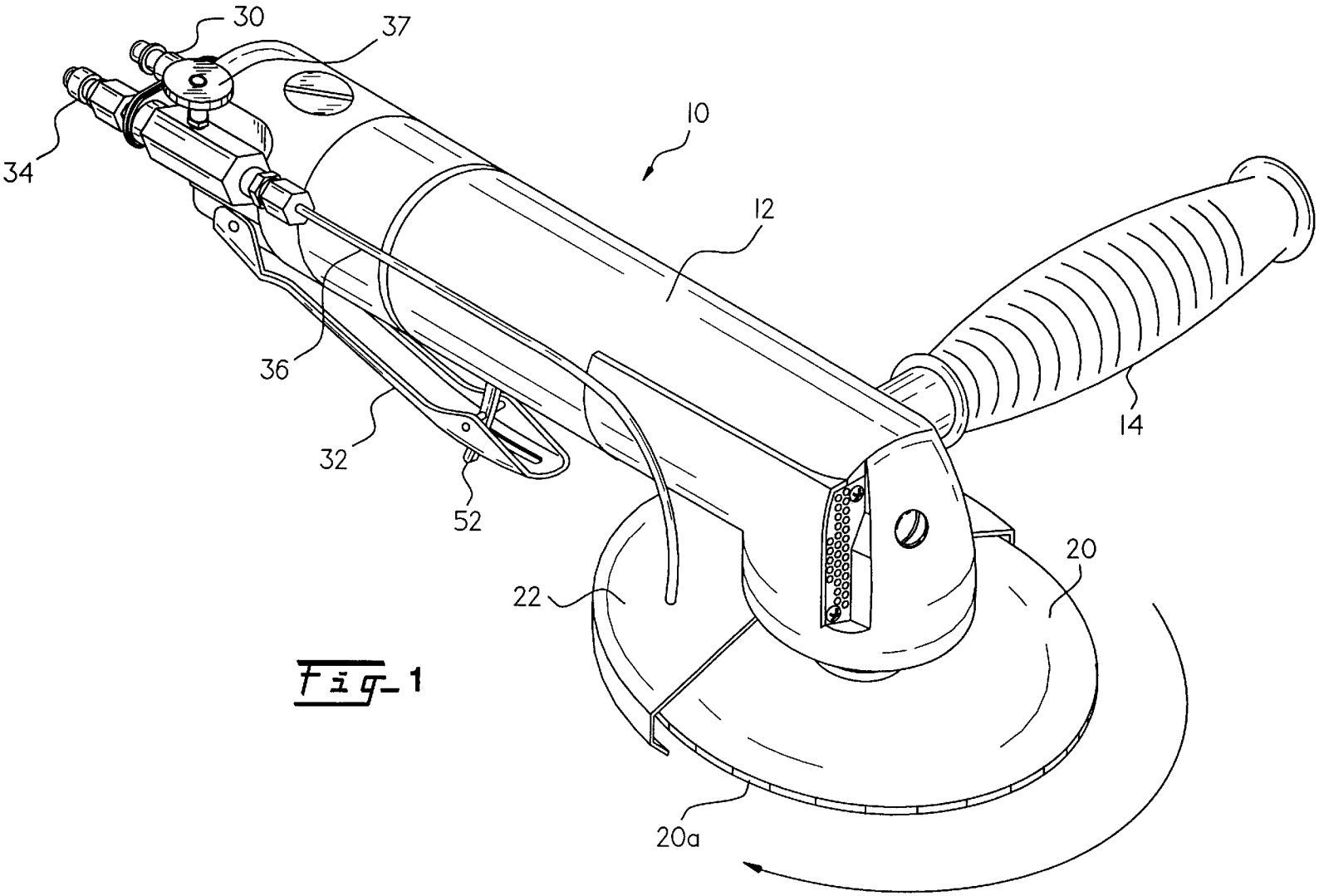
FIG. 1 is a perspective view of a dust-free masonry-cutting tool in accordance with the present invention.
Figure 2:
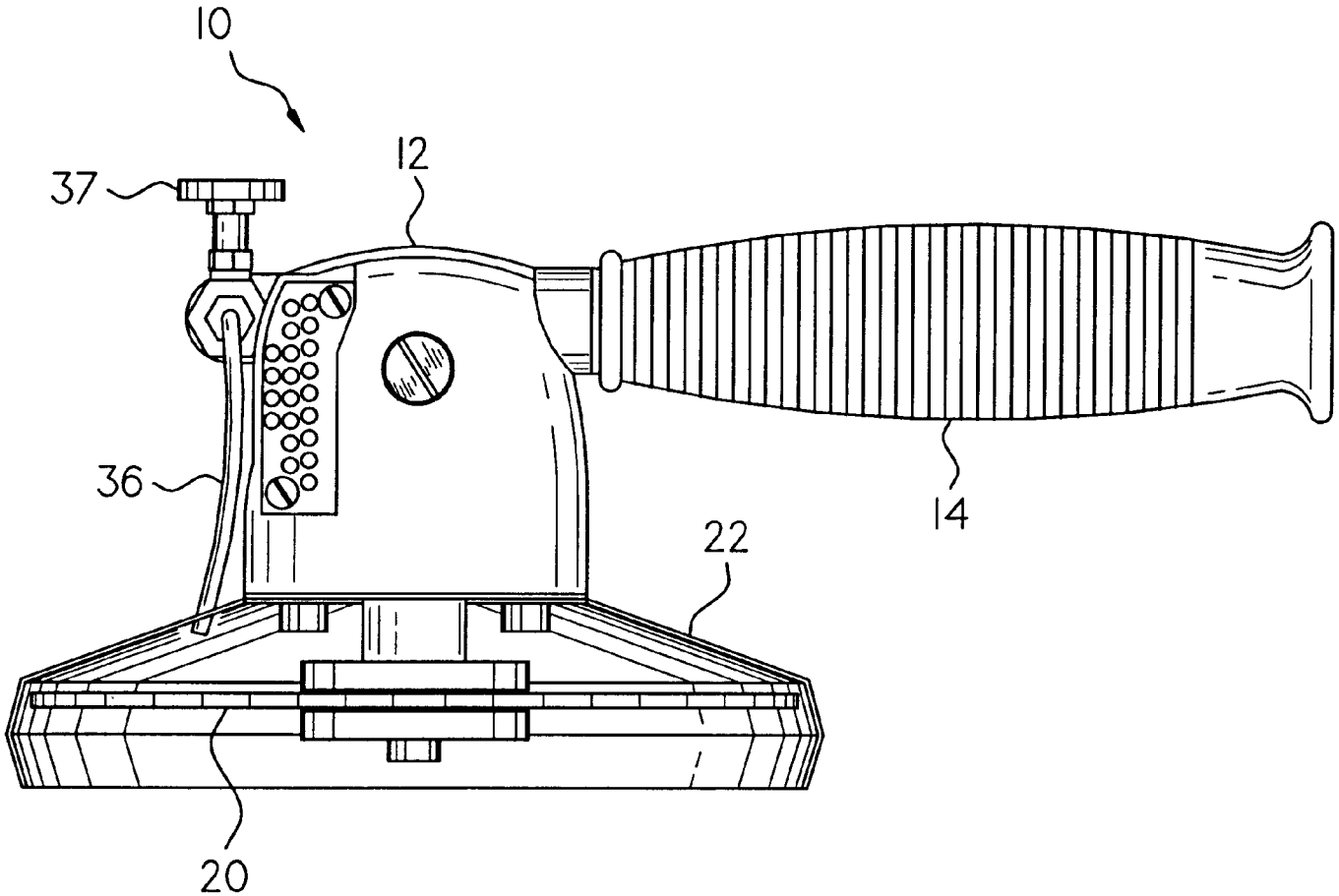
FIG. 2 is an end elevational view of a dust-free masonry-cutting tool in accordance with the present invention.
Figure 3:
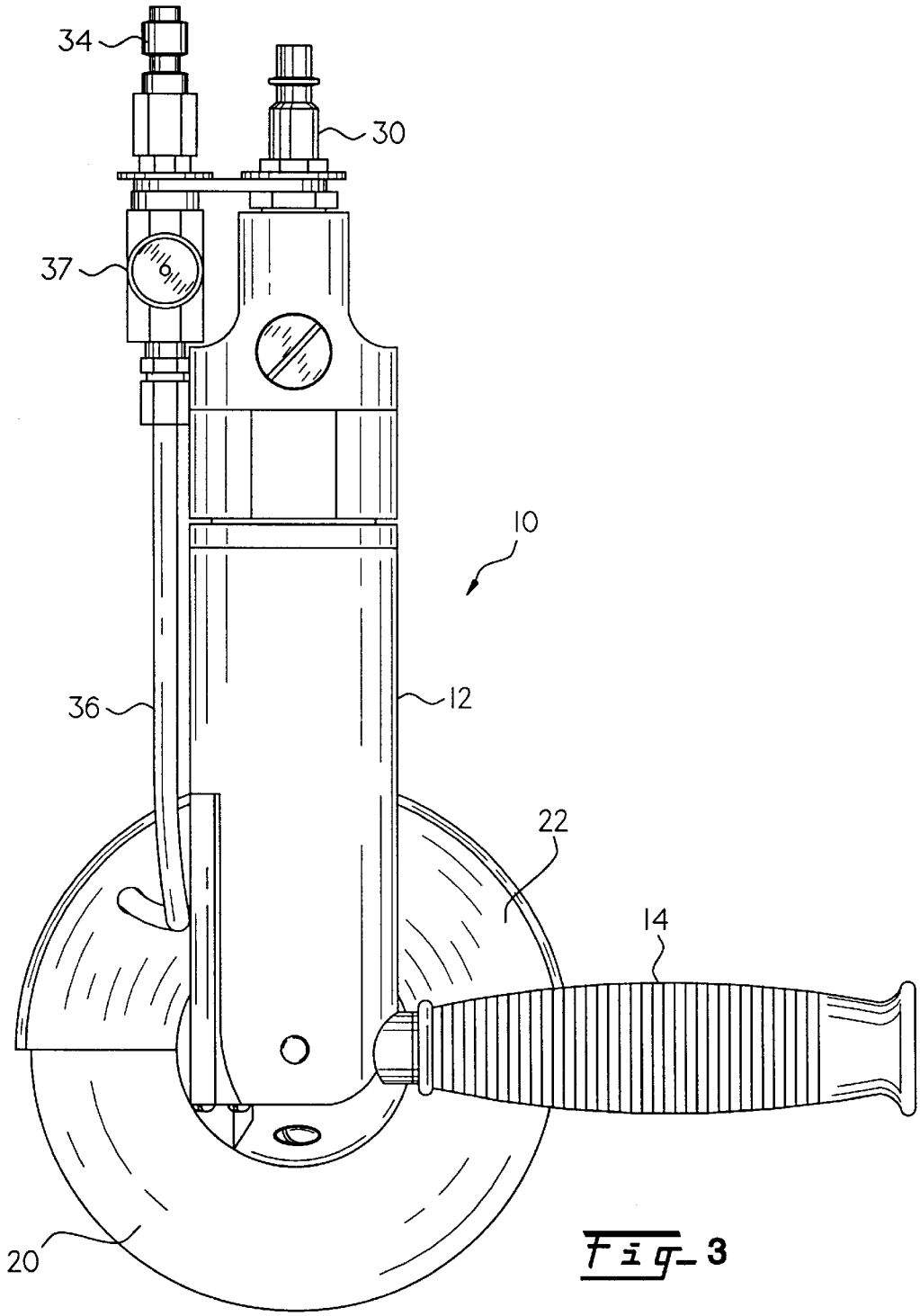
FIG. 3 is a top plan view of a dust-free masonry-cutting tool in accordance with the present invention.
Figure 4:
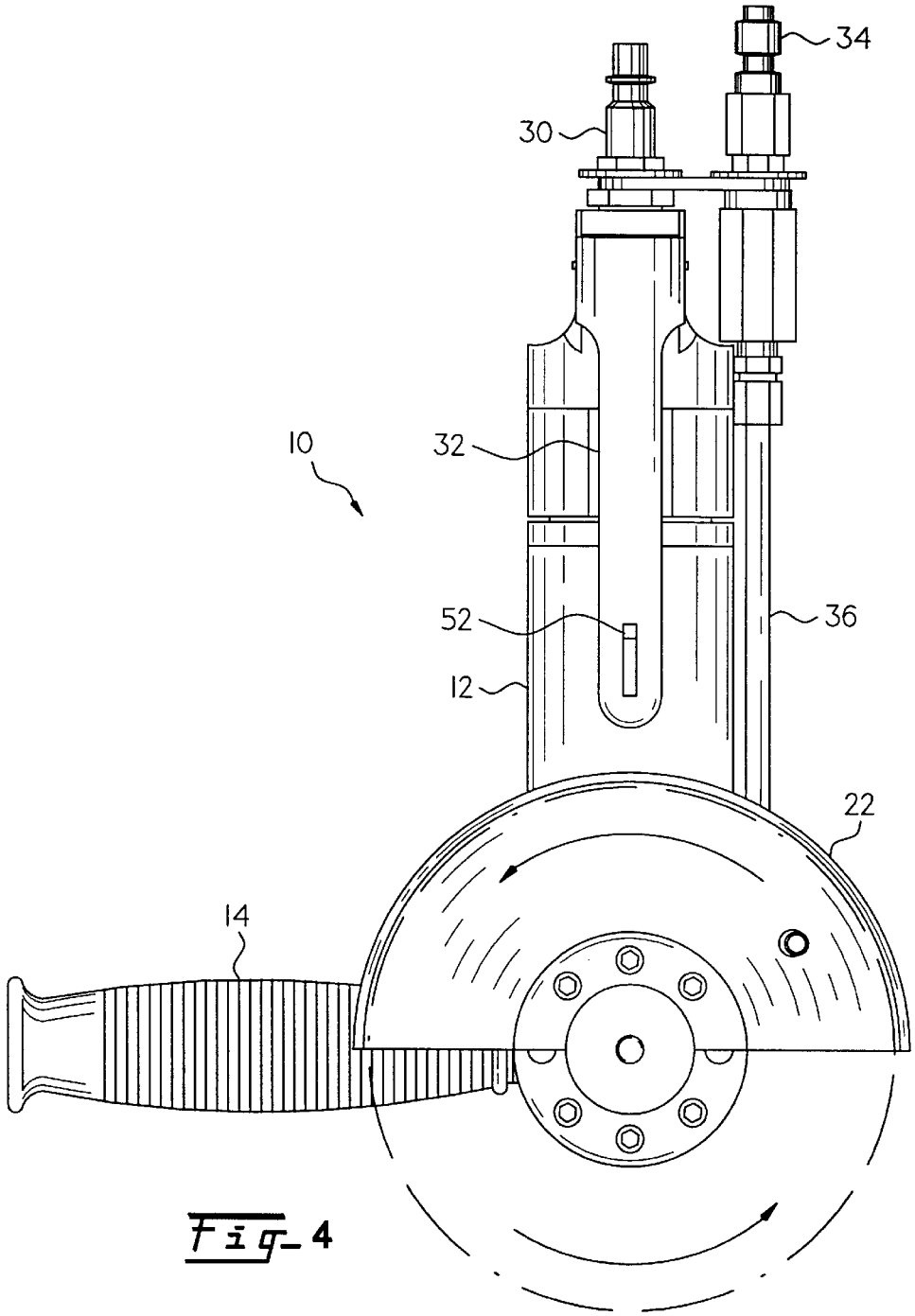
FIG. 4 is a bottom plan view thereof.
Figure 5:
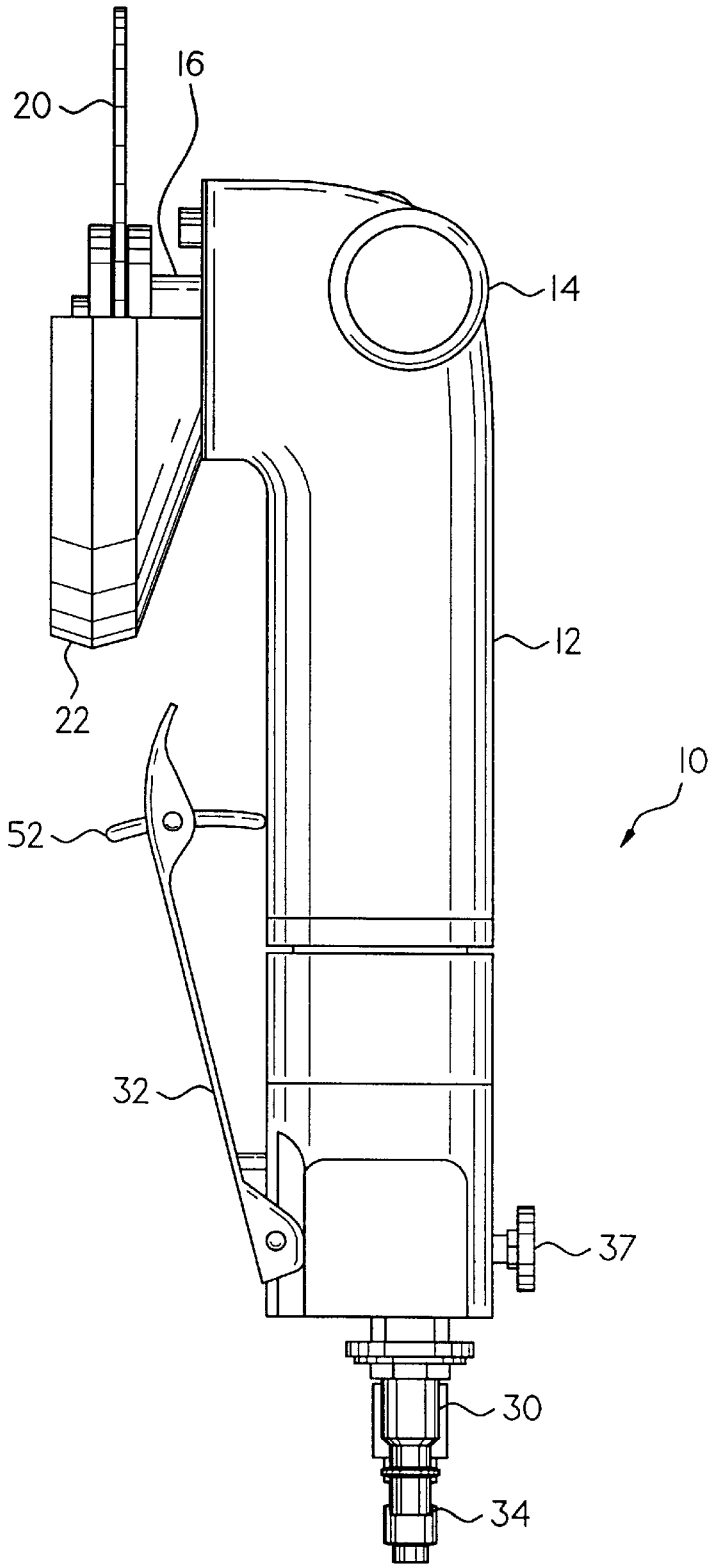
FIG. 5 is a side elevational view of a dust-free masonry cutting tool showing the deadman's switch for actuating the tool between on-off positions.

More specifically, as shown in FIG. 8, the water feed tube 36 mounts on the safety shield 22 proximate to the edge of the shield where the cutting blade 20 enters the safety shield 22. FIG. 1 also shows the rotation of the cutting blade, which is clockwise when viewed from a plan view. FIG. 1 further shows the deadman's safety latch in an unengaged or off position.

FIGS. 2, 4, 8 and 9 show various views of the present invention with the water feed tube 36 mounted through the safety shield 22. The feed tube 36 is laterally placed generally between the edge of the blade and the saw blade collar to advantageously disperse water on the flat upper face of the blade 20, as opposed to dispersing water along the edge of the blade. By dispersing the water along the flat face of the blade, the water in addition to creating a cooling effect on the blade, becomes entrained by the impact with the blade 20. This entraining creates water particles in the proximate vicinity of the cutting. As a result, the water particles combine with the unwanted and hazardous dust particles created when the saw blade performs its function of routing construction material or the like. Once the water particles combine with the dust particles, the resulting slurry is harmlessly deposited back onto the cutting surface, where it can be wiped down and contained in a controlled manner.

Further, by increasing the flow of the water through the feed tube 36, a stream of water can be created which adheres to the saw blade surface. A flow control valve 37 can control flow of water. This stream advantageously attracts and bonds with more dust particles and deposit the resulting slur back onto the cutting surface, as described above. Further, the stream flows back along the flat of the blade into the groove or path cut by the blade creating a desirable flushing of the groove by removing residual slur or dust particles.

Referring to FIGS. 6 and 7, FIGS. 6 and 7 are side elevations view of the present invention showing the deadman switch mechanism. The arm 32 is biased down by a vertical pin 52, which acts as a spring, pushing off of the saw body and forcing the arm into a home or off position. When the pin 52 is rotated in a counterclockwise direction, while simultaneously exerting upward force on the arm 32, the arm 32 forms to the saw body and engages the saw's power. When the upward force is removed by the user, the arm 32 will return to its home position and the saw will turn off, thereby protecting the user should his grip fail or become compromised.

Even though particular embodiments of the present invention have been illustrated and described herein, it is not intended to limit the invention and changes and modifications may be made therein.

What is claimed is:

1. A portable cutting tool comprising:

an elongated generally cylindrical housing;

a rotary shaft having means for detachably mounting a generally disc-shaped cutting blade;

means in the form of a feed tube for directing a liquid coolant to one face of the cutting blade approximately midway between the center of rotation (Cr) and the outer peripheral cutting edge (Cp) wherein rotation of the cutting blade in a predetermined range creates a turbulent air flow over the face of the cutting blade whereby the coolant moves radially outwardly toward the outer peripheral cutting edge of the blade and penetrates the air layer entraining any dust particles formed during a masonry cutting operation and converting the same to a harmless slurry; and said feed tube being laterally disposed between the edge of the blade and saw blade collar to thereby dispose liquid coolant on the flat upper surface of the blade whereby liquid particles are entrained and combine with dust particles created by a cutting operation.

2. A portable cutting tool comprising:

an elongated generally cylindrical housing;

a rotary shaft having means for detachably mounting a generally disc-shaped cutting blade;

means in the form of a feed tube for directing a liquid coolant to one face of the cutting blade approximately midway between the center of rotation (Cr) and the outer peripheral cutting edge (Cp) wherein rotation of the cutting blade in a predetermined range creates a turbulent air flow over the face of the cutting blade whereby the coolant moves radially outwardly toward the outer peripheral cutting edge of the blade and penetrates the air layer entraining any dust particles formed during a masonry cutting operation and converting the same to a harmless slurry;

said feed tube being laterally disposed between the edge of the blade and saw blade collar to thereby dispose liquid coolant on the flat upper surface of the blade whereby liquid particles are entrained and combine with dust particles created by a cutting operation; and semi-circular safety shield circumscribing the cutting blade exposing a portion of the cutting blade, said tube discharge and projecting through said shield so that liquid coolant engages the flat surface of the blade remote from the exposed cutting edge.

* * * * *